US008100639B2

(12) United States Patent
Genin et al.

(10) Patent No.: US 8,100,639 B2
(45) Date of Patent: Jan. 24, 2012

(54) ACTUATING ROD END CONNECTOR

(75) Inventors: Emeric Genin, Nancy (FR); Emmanuel Severin, Thaon les Voges (FR); Alexis Lavez, Hadol (FR); Frederic Gerard, Thaon les Vosges (FR); Muller Philippe, Thaon les Vosges (FR); Francois Grandjean, Thaon les Voges (FR)

(73) Assignee: Honeywell International Inc., Morristown, NJ (US)

( * ) Notice: Subject to any disclaimer, the term of this patent is extended or adjusted under 35 U.S.C. 154(b) by 955 days.

(21) Appl. No.: 12/089,988

(22) PCT Filed: Oct. 13, 2005

(86) PCT No.: PCT/US2005/036891
§ 371 (c)(1),
(2), (4) Date: Apr. 11, 2008

(87) PCT Pub. No.: WO2007/044012
PCT Pub. Date: Apr. 19, 2007

(65) Prior Publication Data

US 2009/0092481 A1 Apr. 9, 2009

(51) Int. Cl.
*F01D 17/16* (2006.01)

(52) U.S. Cl. ..... 415/144; 415/148; 415/161

(58) Field of Classification Search ..... 415/144, 415/148, 161
See application file for complete search history.

(56) References Cited

U.S. PATENT DOCUMENTS

| | | | | |
|---|---|---|---|---|
| 4,120,156 | A | 10/1978 | McInerney | |
| 4,377,070 | A * | 3/1983 | Shadbourne | 60/602 |
| 4,403,538 | A | 9/1983 | Rise | |
| 4,585,207 | A | 4/1986 | Shelton | |
| 5,799,564 | A * | 9/1998 | Pierce | 92/99 |
| 6,405,535 | B1 * | 6/2002 | McEwan | 60/602 |
| 6,883,317 | B2 * | 4/2005 | Heath | 60/602 |
| 2010/0089055 | A1 * | 4/2010 | Severin | 60/602 |

FOREIGN PATENT DOCUMENTS

EP 0976918 2/2000

OTHER PUBLICATIONS

PCT ISR/WO Honeywell.

* cited by examiner

*Primary Examiner* — Igor Kershteyn
(74) *Attorney, Agent, or Firm* — Brian J. Pangrle

(57) ABSTRACT

An improved actuating rod end connector is connected with an actuating rod that extends from a turbocharger assembly actuator mechanism. The rod end connector has a body with an opening at one longitudinal end, and the actuator rod is disposed through the opening. An adjustment member is rotatably disposed within the body and has a threaded inside cavity in communication with the opening. The inside cavity is threadably engaged with a threaded outside surface of the actuator rod. The body includes an actuator rod opening disposed therethrough adjacent the adjustment member to receive a section of the actuator rod therein to facilitate contacting the actuator rod disposed within the body from outside of the rod end connector. An attachment opening is disposed through the body to facilitate attachment of the rod end connector with a linkage member, e.g., a linkage member connected with a movable member of the turbocharger.

20 Claims, 5 Drawing Sheets

*Fig. 1*- Prior Art

ACTUATING ROD END CONNECTOR

FIELD OF THE INVENTION

This invention relates generally to an adjustable rod end connector and, more particularly, to an adjustable rod end connector specially engineered for attachment with a turbocharger actuating rod in a manner that minimizes or eliminates the actuating rod from rotating relative to the adjustable rod end connector when it is attached therewith, thereby preventing potential harm that could come from any actuator mechanism connected with the rod.

BACKGROUND OF THE INVENTION

The use of actuating mechanisms are well known in a variety of different applications for the purpose of causing a desired movement of a certain element or member that is connected thereto. Typical actuating mechanisms comprise an actuator or an actuating device that is itself capable of initiating a desired movement. Actuating devices are well known in the art and can be configured to provide such initiating movement by mechanical, electrical, hydraulic, pneumatic, vacuum, and combinations of these techniques.

Such actuating devices are typically controlled by a mechanical or nonmechanical means to provide such initiating movement in response to some existing or anticipated condition to cause a desired effect. Typically, such actuating devices are not connected directly to the element or member that will eventually be moved, but rather are connected to the end movement element or member by an intermediate element or a linkage of two or more intermediate elements. For example, when the actuating device is configured to initiate movement in one direction, an intermediate member or a linkage of two or more intermediate members may be used to translate the movement provided by the actuating device into a different direction and/or to facilitate attachment with end movement element that may be configured at an angle that is not aligned with the actuating device.

One application of actuating device is with turbochargers for gasoline and diesel internal combustion engines. Actuating devices can be used with turbochargers to affect movement of different members that control turbocharger performance. For example, actuating devices can be used to control the amount of exhaust gas that is directed to a turbine wheel mounted in a turbine housing. In one such example embodiment, the actuating device is connected via a suitable linkage mechanism to move a plurality of vanes that are movably mounted within the turbine housing.

Alternatively, turbochargers may make use of an actuating device to control the amount of boost pressure directed to the engine intake system by controlling the amount of exhaust gas that is directed into the turbine housing. A wastegate mechanism or valve is used in conjunction with the turbocharger to reduce the amount of exhaust gas directed from the engine to the turbine housing when a preset control parameter has been achieved. In such example, and actuating device is used to operate the wastegate valve as needed to provide the desired control over the exhaust gas entering the turbine housing.

In either such turbocharger application, the actuator or actuating device is connected to the turbocharger member to be moved via a linkage that includes a rod attached to the actuator at one of its ends, and that is attached to an adjustable rod end connector at its opposite end. The rod end connector is configured to both accommodate attachment with the rod end and provide a connection point with one or more further linkage members or elements of the movable turbocharger member.

In many applications, the actuator or actuating device is one having an internal mechanism that can be damaged should the intermediate element or member that it is connected to is moved in a manner that is contrary to the movement direction of the actuating device. For example, when the actuating device is one operated by vacuum or pneumatic principles and includes a diaphragm or the like to effect the same, rotation of the intermediate element or member, e.g., a rod, connected to the diaphragm and extending outwardly therefrom can cause the diaphragm to be damaged, thereby adversely impacting is proper functioning and shortening its service life.

Rod end connectors known in the art, and that are used as part of mechanism or linkage for attaching to a rod extending from the actuating device, while constructed to accommodate attachment with the rod are not designed to prevent an unwanted twisting or turning of the rod when the rod end connector is being attached thereto. Accordingly, the use of such convention rod end connectors are known to cause unwanted damage to the actuator or actuating device during such attachment.

It is, therefore, desired that a rod end connector be constructed in a manner that minimizes or eliminates the potential for actuator damage during attachment of the rod end connector on a rod connected to the actuator. It is also desired that such rod end connector be constructed in a manner that provides an improved degree of fixed placement on the rod when it is attached thereto, to prevent unwanted loosening that may occur during operation. It is further desired that the rod end connector be constructed in a manner that provides a reduced degree of friction between itself and a further connection member, element, or linkage to facilitate ease of actuating mechanism movement.

SUMMARY OF THE INVENTION

An improved actuating rod end connector of this invention can be used in conjunction with a turbocharger assembly to cause a desired movement of a movable turbocharger device. The turbocharger assembly can include a turbine housing having a turbine wheel disposed therein, and a compressor housing having a compressor impeller disposed therein. A turbocharger center housing is interposed between the turbine housing and the center housing.

The turbocharger assembly may further include an actuator mechanism connected to the turbocharger comprising, wherein the actuator mechanism has an actuating rod extending therefrom. The improved rod end connector can be attached to the actuating rod and includes a body having an opening at one longitudinal end, wherein the actuator rod is disposed within the opening. The rod end connector includes an adjustment member rotatably disposed within the body and a threaded inside cavity in communication with the opening. The inside cavity is threadably engaged with a threaded outside surface of the actuator rod.

An actuator rod opening is disposed through the body and is positioned adjacent an axial end of the adjustment member to receive a section of the actuator rod therein to facilitate contacting the section of the actuator rod from a position outside of the body. The actuator rod opening enables one to contain the actuator rod in a fixed position relative to the rod end connector, which feature is desired when the rod end connector is being tightened to the actuator rod to prevent unwanted turning of the actuator rod during this process, which could otherwise possibly cause damage to the actuator. The rod end connector also includes an attachment opening disposed through the body to facilitate attachment of the rod end connector with a linkage member, e.g., a linkage member that is connected with a movable member of the turbocharger.

BRIEF DESCRIPTION OF THE DRAWINGS

The invention will be more clearly understood with reference to the following drawings wherein.

DETAILED DESCRIPTION OF THE INVENTION

Rod end connectors of this invention are specially constructed to provide an adjustable positioning of an actuator rod disposed therein, while also comprising a structure that facilitates fixedly holding the actuator rod relative to the rod end connector in such a manner as to minimize or prevent possible turning of the rod relative to the rod end connector during the task of attaching the rod end connector to the rod. In an example embodiment, the rod end connector comprises a body having a two-piece construction formed from two complementary body members, and further comprises a structure configured to enhance the fixed attachment of the rod end connector to the rod.

Figure 1:
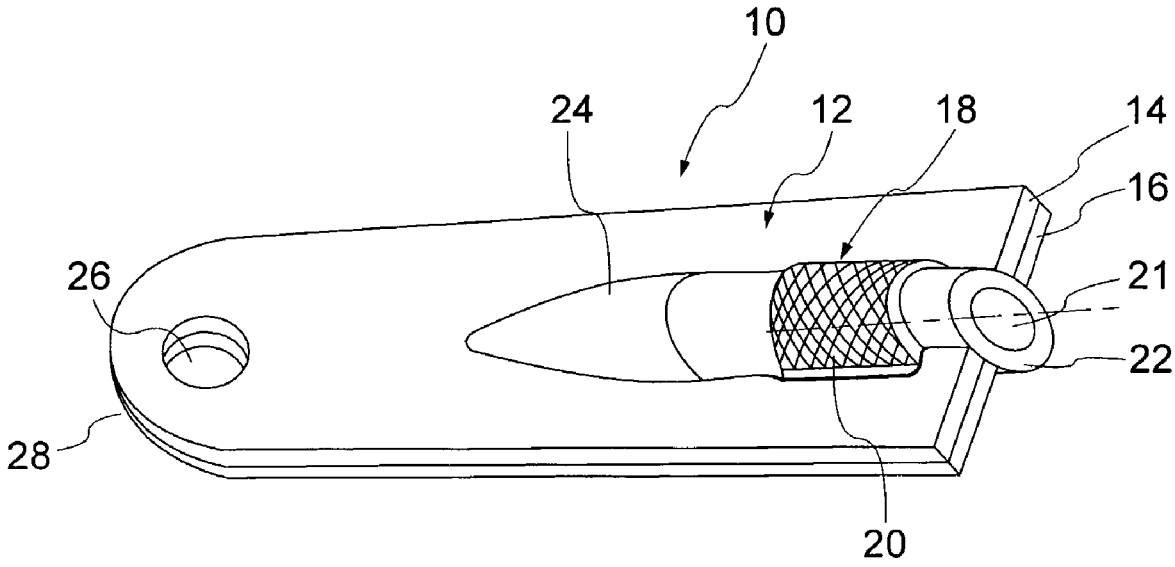
FIG. 1 is a perspective view of a prior art rod end connector.

FIG. 1 illustrates a prior art rod end connector 10 that comprises a body 12 that is formed from two body members 14 and 16. The two body members are configured having complementary surface features and are joined together by conventional method such as by brazing, welding, or the like. The body is configured to accommodate placement of a rotatable threaded member 18 therein. The threaded member 18 has a knurled outside surface 20 to facilitate grasping by hand or device, and has a threaded inside cavity 21 that is configured to cooperate with a threaded end of an actuator rod. The threaded member includes reduced diameter axial ends (not shown) that fit within surrounding portions of the body and are sized to facilitate rotatable movement of the threaded member within the body.

The body includes an opening 22 at ones of its ends that is sized to accommodate an axial end of the threaded member therein, and that is provided to accept placement of an actuator rod end therein. The surface of the body end adjacent the opening 22 is one defined by the edge thickness of each of the body members. The body includes an inner cavity (not shown), that is defined by outwardly extending body surface portions 24, that extends axially a distance from the threaded member, and that is sized and shaped to contain and enclose a portion of the actuator rod therein. More specifically, the inner cavity is sized to accommodate therein and enclose a portion of the actuator rod extending beyond the threaded member 18. Such portion of the actuator rod is completely surround by the body 12 and, thus is not accessible from outside of the rod end connector.

The body 12 further includes an aperture 26 that is positioned at an end 28 of the body opposite the opening 22. The aperture 26 in such rod end connector 10 is provided in the form of an opening that extends perpendicularly through the body, and that is sized for placement of a desired connection element or member therein. In an example embodiment, the connection element or member that is attached to the rod end connector 10 via the aperture 26 may be provided in the form of a screw, rod, or other cylindrically-shaped member.

Figure 2:
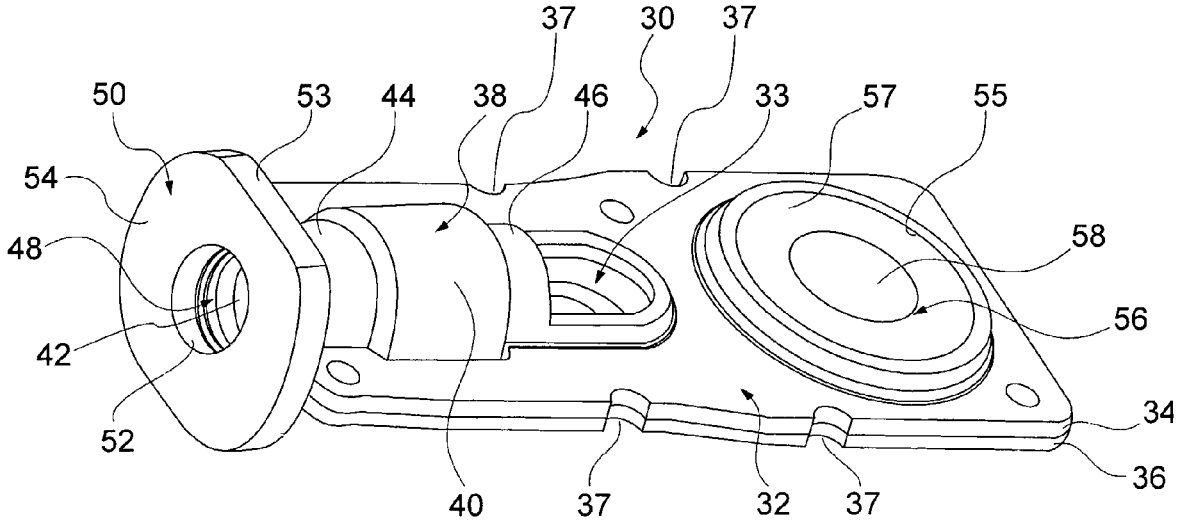
FIG. 2 is a perspective view of a rod end connector constructed in accordance with this invention.

FIG. 2 illustrates a rod end connector 30 of the invention comprising a body 32 that, in an example embodiment, is of a two-piece construction formed from two complementary body members 34 and 36. In an example embodiment, each body member is formed from a structurally rigid material. In an example embodiment, each body member has a stamped metal construction and is configured to complement one another when joined together to form the body. The body members can be held or joined together to form the body by bonding, welding, interference, rivoting, or stamping techniques and the like known in the art to join adjacent metal members together.

In an example embodiment, the body members 34 and 36 can include one or more registration features 37 that are positioned at selected identical locations along each body member for the purpose of ensuring that the body members are properly aligned with one another prior to being joined together. The registration features are understood to vary in their particular configuration and placement. In an example embodiment, each body member comprises four registration features 37 provided in the form of slots or notches that are positioned at identical locations along an outside edge surface. Before being joined together, the body members are aligned with one another so that the registration features of one body member are aligned with the registration features of an adjacent body member, thereby ensuring proper alignment and orientation of the two body members.

The connector 30 includes a threaded or adjustment member 38 that is rotatably disposed within the body. The threaded member is provided in the form of a generally cylindrical member having a knurled outside surface 40 to facilitate grasping by hand or by tool, and a threaded inside cavity 42 extending axially therethrough. In an example embodiment, the inside cavity 42 is threaded to complement and provide threaded engagement with a threaded end of an attachment member, e.g., an actuator rod or the like. The threaded member 38 includes reduced diameter axial end portions (not shown) on either side of the knurled surface that are sized for rotatable retention within the body by respective radially extending surface features 44 and 46 projecting outwardly therefrom. The body radially extending surface features also cooperate with opposed axially-facing surfaces of the threaded member to control axial movement of the threaded member within the body. Configured and assembled in this manner, the threaded member 38 is disposed within the body 32 in an axially fixed position but is free to move rotatably therein.

The body includes an opening 33 that extends perpendicularly therethrough and that is positioned adjacent the threaded member 38. In an example embodiment, the opening 33 extends axially within the body a distance from the radially extending surface feature 46 positioned around the axial end of the threaded member. The opening 33 is sized and configured to accommodate placement of an end portion of an attachment member, e.g., the end portion of an actuator end, therein. The opening 33 is sized having an axial length to accommodate a desired length of the threaded attachment member end portion after it has been passed through the threaded member. In an example embodiment, the opening 33 is formed from slots or windows that are cut or otherwise formed from each of the body members. In an example embodiment, each body member is provided in the form of a stamped sheet of metal and the windows are cut out of each body member before the two body members are joined together.

Configured in this manner, the opening 33 serves to provide direct access to the attachment member from the body after it has been passed into the connector for the purpose of contacting and grasping the attachment member. This ability to contact and grasp a portion of the attachment member while it is disposed within the connector is desired to ensure that the attachment member is not twisted or turned when the rod end connector is being fixedly attached thereto, which turning could operate to damage an actuator or actuating device that the attachment member is connected to.

The body includes an opening 48 positioned along one of its longitudinal ends that extends axially therein and that is in communication with the threaded member inside cavity 42. The opening 48 is configured to provide access to the threaded member inside cavity from a position outside of the body. In an example embodiment, the opening is defined by an axially-facing edge surface of the radially extending surface feature 44. In an example embodiment, the threaded member inside cavity is positioned adjacent the opening 48 to provided threaded engagement with an attachment member entering the opening.

The body further includes a flange 50 that is positioned adjacent the opening 48 and that defines a longitudinal end of the body. The flange 50 is configured having a central opening 52 that is sized to facilitate passage of an attachment member therein for further axial passage through the opening 48 and into the threaded member internal cavity 42. The flange 50 extends radially a desired distance from the opening 48 and is generally perpendicular to the body. The flange has a planar outside surface 54 that is sized to provide a desired contact surface with a lock nut or the like that is used to secure the position of the attachment member within the end rod connector 30. In an example embodiment, the flange 50 is provided as a separate member that is attached to the longitudinal end of the body adjacent the opening 48 after the two body members are joined together. The flange can be formed from a metal material and joined to the body by welding, brazing or the like.

Configured in this manner, the flange operates to ensure good perpendicularity with the attachment member, and ensure good flatness to provide an enhanced degree of surface contact between the body and the lock nut to assist in preventing the lock nut from loosening in service. It is, therefore, desired that the flange be formed from a material having a sufficient thickness such that it does not distort structurally when the lock nut is tightened thereagainst.

The flange 50 can have a circular outer edge, or may be have an outer edge that is configured differently for the purpose of engaging or fitting together with a device or tool used for holding the rod end connector, e.g., to facilitate attachment or adjustment of the rod end connector with an attachment member. As illustrated in FIG. 2, in an example embodiment, the flange is configured having an outer edge including one or more surface features that are provided to assist in holding the rod end connector. In an example embodiment, the flange outer edge is configured having diametrically opposed flat surfaces 53 that are sized to fit within a device or fixture for retaining or holding the rod end connector for installing and attaching the attachment member therewith.

The body further includes an opening 55 positioned adjacent an end of the body opposite from the flange 50. The opening 55 is disposed through the body and is configured to accommodate a ball member 56 therein. In an example embodiment, the opening 55 is formed by windows or slots in each of the body members that when combined together form the opening. The opening also preferably includes an inside surface that is radiused or concave in shape to accommodate a radiused outside surface of the ball member therein in a manner that both traps the ball member within the open and enables the ball member to move freely therein. In an example embodiment, the ball member 56 is free to rotate omnidirectionally within the opening. For the ball member to move freely within the opening is important that the body members be joined together in alignment with one another. The presence of the registration surfaces 37 as noted above operates to assist in this regard.

In an example embodiment, the ball member 56 comprises a circular outside surface that has a radius of curvature that complements the inside surface of the opening 55. The ball member 56 has a thickness that is defined by two opposed axial surfaces 57. In an example embodiment, the thickness is preferably the same or greater than the outside edges of the opening to facilitate attachment with a further attachment member without binding or interference with the rod end connector body. The ball member 56 includes a central opening 58 that extends therethrough between the axial surfaces, and that is sized to accommodate attachment with a desired further attachment member or linkage, e.g., in the form of a bolt or other cylindrical member. In an example embodiment, it is desired that the ball member be sized having axial surfaces that are larger than that of any attachment member retaining elements that it is connected with to enable some degree of ball member free floating movement within the body once attached.

Configured as such, the ball member 56 operates to facilitate attachment with a further attachment member or linkage in a manner that both optimizes different angles of attachment with the body and that reduces friction between the rod end connector and such further attachment member. This feature is desired for the purpose of reducing possible binding and friction between the rod end connector the further attachment member.

Figure 3:
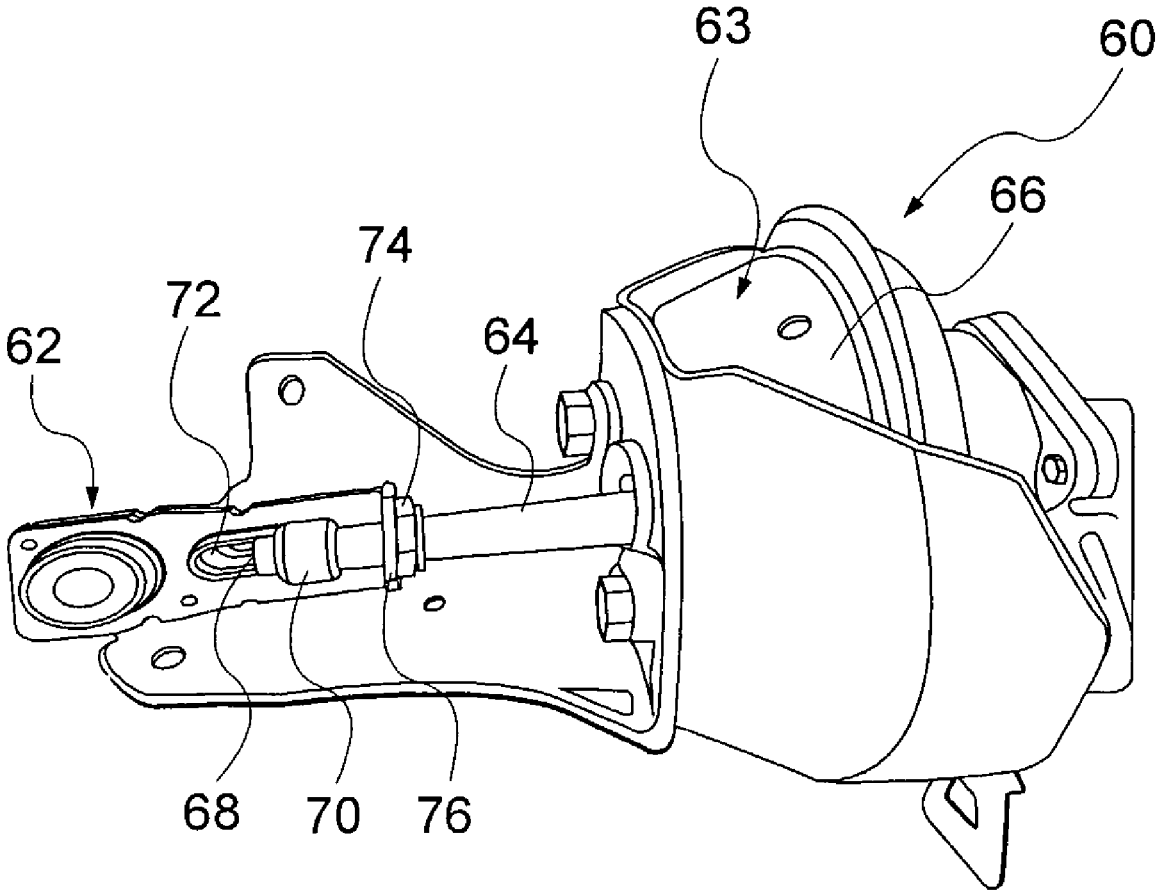
FIG. 3 is a perspective view of an actuator mechanism comprising the rod end connector of FIG. 2.

FIG. 3 illustrates an actuating mechanism 58 comprising the rod end connector 62 described above and illustrated in FIG. 2, as connected with and used in conjunction with an actuator or actuating device 63. The rod end connector 62 is shown attached to an actuating rod 64 that extends from the actuator 63. The actuator can be operated mechanically, hydraulically, electrically, pneumatically, by vacuum, combinations thereof, and the like.

In an example embodiment, the actuator 63 is operated by pneumatic means and comprises a canister body 66, and a diaphragm member (not shown) disposed therein. The actuator rod 64 is connected at one of its axial ends to the diaphragm member, and is moved inwardly and outwardly by the actuator depending on the desired control effect. Pneumatic actuators useful in forming actuating mechanisms comprising the rod end connector include those disclosed, e.g., in U.S. Pat. No. 6,662,708, that is incorporated herein by reference.

The actuator rod 64 includes an axial end 68 opposite the diaphragm that projects outwardly from the actuator 63 and that includes a threaded outside surface. The actuator rod end 68 is disposed through the opening extending through the longitudinal end of the rod end connector and is threadably engaged with the threaded member 70. The desired attachment length between the rod end connector 62 and the actuator rod 64 is adjusted by rotation of the threaded member 70. In an example embodiment, the actuator rod is adjusted so that a portion of the rod end 68 projects axially through the threaded member 70 and into the opening 72. This is desired to permit contacting and fixing of the rod end 68 during the process of attaching the rod end connector to the actuating rod to ensure that the actuating rod is not twisted or turned during the process.

As shown in FIG. 3, a lock nut 74 is also threadably engaged with the actuator rod 64 and is tightened onto the rod end connector flange 76 to ensure that the actuator rod is fixedly attached with the rod end connector to minimize or prevent unwanted loosening of the attachment during operation. As mentioned above, the flange operates to provide increased surface area contact between the lock nut and the rod end connector body to help ensure that such unwanted loosening does not occur.

The actuator mechanism described above and illustrated in FIG. 3, can be used with a turbocharger to cause a desired movement of a turbocharger member. For example, the actuator mechanism can be used to cause the movement of one or more movable members within the turbocharger to control the amount of exhaust gas that is directed to a turbine housing. In such example application, the actuator mechanism can be used with a variable geometry turbocharger to cause a desired movement of a plurality of aerodynamic vanes that are movably disposed within the turbocharger. Alternatively, the actuator mechanism can be used to control the movement of a turbocharger wastegate valve.

Figure 4:
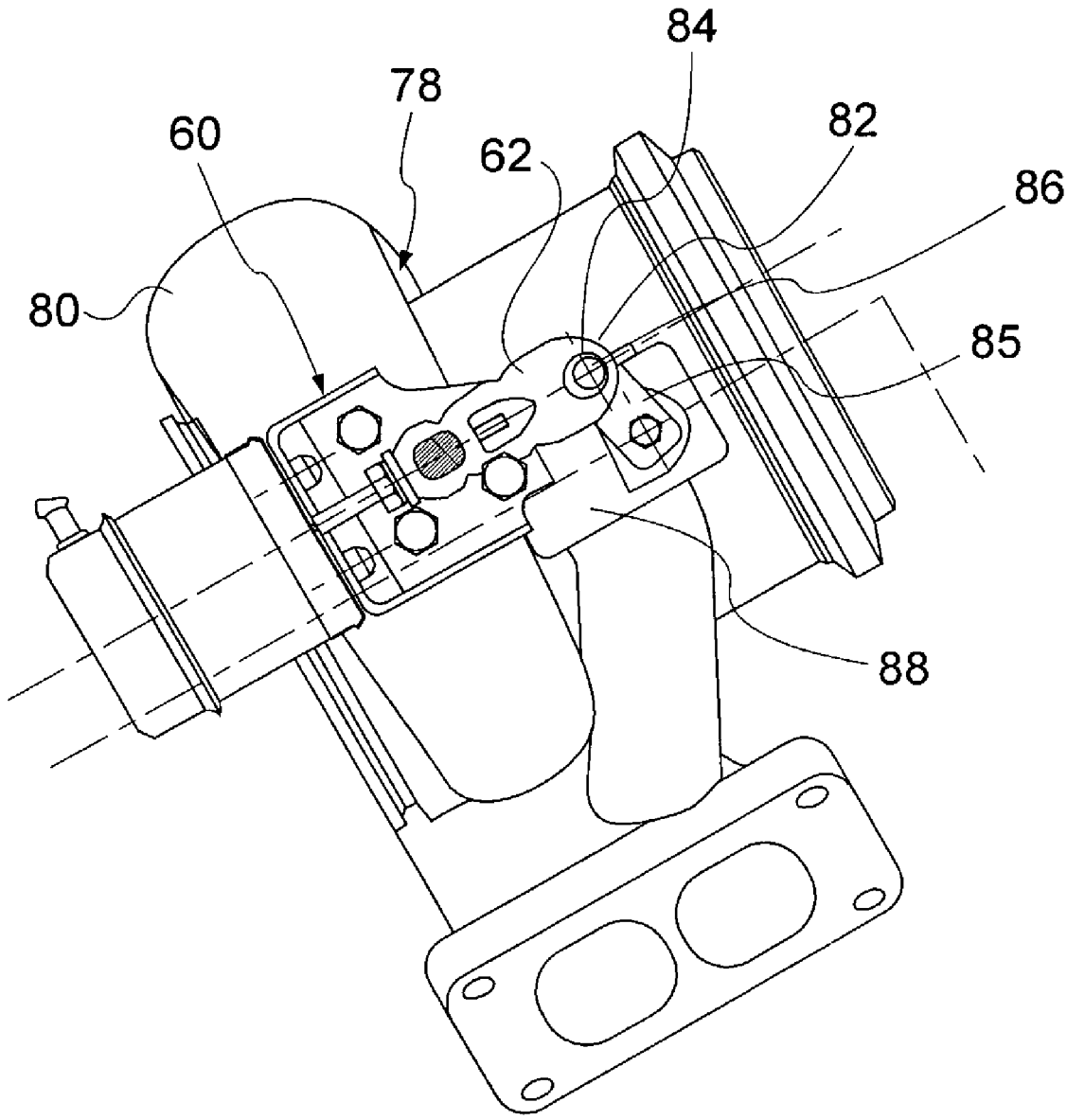
FIG. 4 is a perspective view of the actuator mechanism of FIG. 3 as used in conjunction with a turbocharger.

FIG. 4 illustrates the actuator mechanism 60 of FIG. 3 as connected with a turbocharger 78 used with internal combination engines. The turbocharger 78 generally comprises a center or bearing housing, a turbine housing 80 attached to one end of the bearing housing, and a compressor housing attached to an opposite end of the center housing. A common shaft is disposed within the center housing and includes a turbine attached at one end, that is disposed within the turbine housing, and a compressor impeller attached at an opposite end, that is disposed within the compressor housing. The turbine housing includes an exhaust inlet for receiving exhaust from an internal combustion engine and for directing it to the turbine, and an exhaust outlet for directing exhaust gas out from the turbine housing after it has been passed along the turbine. The compressor housing includes an air inlet for receiving air and directing the same to the compressor housing, and an air outlet for receiving pressurized air from the compressor impeller and directed it out of the compressor housing and to an air inlet or intake system of an internal combustion engine.

In an example embodiment, the actuation mechanism 60 is attached to a portion of the turbocharger, e.g., by bolted connection to a turbocharger housing, and the end 82 of the rod end connector 62 comprising the ball member 84 is attached to a further actuator element in the form of a linkage 85. The linkage 85 is attached to the rod end connector by way of a pin 86 or the like that is sized to fit within the opening through the ball member 84.

In an example embodiment, the linkage is attached at its opposite end to a turbocharger member, e.g., a unison ring, that is connected with a plurality of vanes movably disposed within the turbocharger, to cause a desired movement of the vanes depending on turbocharger and/or engine operating conditions. In the example illustrated in FIG. 4, the linkage is shown as being attached to a turbocharger wastegate valve or mechanism 88 that is configured to control the amount of exhaust gas directed to the turbocharger.

Figure 5:
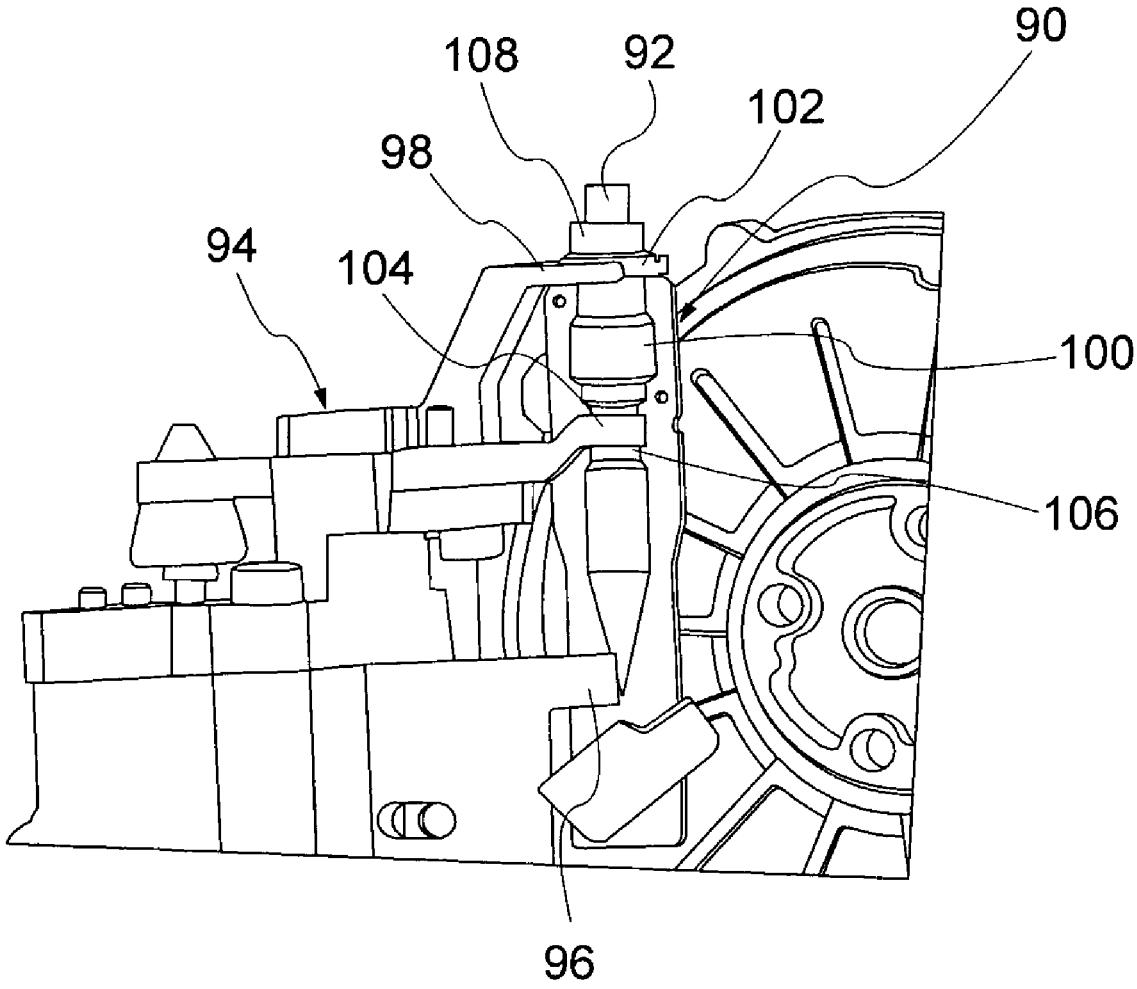
FIG. 5 is a perspective schematic view of a fixture assembly used for attaching the rod end connector.

It is to be understood these are but a few example applications of how the rod end connector can be used in conjunction with an actuator mechanism, and that the rod end connector can be used with a variety of other types of actuator mechanisms, that can be used to actuate devices that may or may not be related to turbochargers The rod end connector can be attached to an actuator member, such as an actuator rod, by a variety of different methods. In an example embodiment, the rod end connector is attached to an actuator rod using a fixture that is specially configured to facilitate such attachment. FIG. 5 illustrates the rod end connector 90 as described above that is attached to an actuator rod 92 using an attachment fixture 94. The attachment fixture 94 in this example embodiment is configured to both hold the rod end connector body fixedly in place, and hold the actuator rod end so it does not turn relative to the rod end connector body.

Specifically, the attachment fixture 94 comprises a lower holding element 96 that is configured to connect with a portion of the rod end connector body adjacent an end of the body near the ball member, and an upper holding element 98 that is configured to connect with a portion of the rod end connector body adjacent an opposite end of the body near the opening to the threaded member 100. In an example embodiment the upper holding element 98 is configured to attach with the rod end connector flange 102 and the flange is configured as noted above having planar diametrically opposed edge surfaces for this purpose.

The attachment 94 fixture also includes a rod attachment member 104 that is configured to grasp and hold the portion of the actuator rod end that extends axially away from the threaded member and that is at least partially disposed through the opening 106. In an example embodiment, the rod attachment member 104 comprises a pair of opposed arms that are moved radially inwardly to make contact with the actuator rod end once the rod end connector is positioned within the fixture. It is to be understood that the method by which the rod attachment member is actuated to make contact with and hold the actuator rod end in place can and will vary. In an example embodiment, the opposed arms are moved radially inwardly to contact with actuator rod end by use of a conical member that is moved upwardly between opposed ends of the two opposed arms.

Configured in this manner, the fixture 94 operates to hold both the rod end connector body fixedly in place, and the actuator rod fixedly in place relative to the rod end connector. This fixturing of the rod end connector and actuator rod is desired so to permit the desired tightening of the lock nut 108 around the actuator rod and onto the flange without twisting or turning the actuator rod. As noted above, the turning of the actuator rod is not desired because such turning (in the event that the actuator is already attached to a device to be actuated such as a turbocharger as shown in FIG. 5) can cause damage to the actuator, e.g., in the case that the actuator is a pneumatic actuator and the actuator rod is attached to a diaphragm. In such case, unwanted turning of the actuator rod during tightening of the lock nut can cause the diaphragm to be damaged within the actuator.

A feature of the rod end connector is that is comprises an opening disposed through the body that is configured to permit access to a section of the actuator rod that is attached to the rod end connector, which access is desired for the purpose of holding the actuator rod in a fixed position relative to the rod end connector body during attachment of the actuator rod. As noted above, this feature operates to minimize or eliminate the possibility of actuator damage that can occur from rotation of the actuator rod within the actuator during such attachment process.

A further feature of the rod end connector is that it includes a moveable ball member disposed within the body to both facilitate versatility in the manner in which rod end connector can be attached to a further attachment member or linkage, and to facilitate a low friction connection therebetween. A further feature of the rod end connector is that the body members used to form the body each include registration features that enable each body member to be aligned with one another prior to being joined together to ensure that all openings formed within the body between complementary surface features are properly aligned and oriented relative to one another. A still other feature of the rod end connector is the presence of a flange for the purpose of providing an increased surface area to ensure a secure attachment between a lock nut and the body to minimize or prevent unwanted loosening during operation.

Having now described the invention in detail as required by the patent statutes, those skilled in the art will recognize modifications and substitutions to the specific embodiments disclosed herein. Such modifications are within the scope and intent of the present invention.

What is claimed:

1. A turbocharger assembly comprising:

a turbine housing having a turbine wheel disposed therein;

a compressor housing having a compressor impeller disposed therein;

a center housing interposed between the turbine housing and the center housing; and an actuator mechanism connected to the turbocharger comprising:

an actuator having an actuating rod extending therefrom; and a rod end connector attached to the actuating rod, the rod end connector comprising:

a body having an opening at one longitudinal end and the actuator rod being disposed within the opening;

an adjustment member rotatably disposed within the body and including a threaded inside cavity in communication with the opening, the inside cavity being threadably engaged with a threaded outside surface of the actuator rod;

an actuator rod opening disposed through the body and positioned adjacent an axial end of the adjustment member to receive a section of the actuator rod therein to facilitate contacting the section of the actuator rod from a position outside of the body; and an attachment opening disposed through the body for attachment with a linkage member.

2. The turbocharger assembly as recited in claim 1 wherein the rod end connector body comprises two joined together body members.

3. The turbocharger assembly as recited in claim 2 wherein the rod end connector body members each include registration surface features that are positioned at identical locations to confirm alignment of the body members.

4. The turbocharger assembly as recited in claim 1 wherein the rod end connector comprises a flange that extends radially outwardly from the longitudinal end of the body having the opening, the actuator rod being disposed through a central opening through the flange.

5. The turbocharger assembly as recited in claim 4 wherein the rod end connector comprises a lock nut that is threadably engaged with an outside threaded surface of the actuator rod, and wherein the lock nut is positioned adjacent the flange.

6. The turbocharger assembly as recited in claim 1 wherein the rod end connector attachment opening further comprises a ball member that is movably disposed therein.

7. The turbocharger assembly as recited in claim 6 wherein the rod end connector ball member is movable omnidirectionally within the opening, includes a radiused outside surface and opposed axially facing surfaces, and includes a centrally positioned opening extending through the axially facing surfaces.

8. The turbocharger assembly as recited in claim 1 wherein the actuator is pneumatically operated and the actuator rod is connected to a diaphragm disposed within the actuator.

9. The turbocharger assembly as recited in claim 1 further comprising a wastegate mechanism, and wherein the linkage member is attached to the wastegate mechanism.

10. The turbocharger assembly as recited in claim 1 further comprises a plurality of vanes movably disposed within the turbine housing, and wherein the linkage member is connected with the vanes.

11. An actuator mechanism used with a turbocharger assembly comprising a turbine housing having a turbine wheel disposed therein, a compressor housing having a compressor impeller disposed therein, and a center housing interposed between the turbine housing and the center housing, the actuator mechanism comprising:

an actuator comprising an actuator rod extending therefrom; and a rod end connector attached to the actuating rod, the rod end connector comprising:

a body formed from two joined together body members and having an opening at one longitudinal end, the actuator rod being disposed within the opening;

an adjustment member rotatably disposed within the body and including a threaded inside cavity in communication with the opening, the inside cavity being threadably engaged the actuator rod;

an actuator rod opening disposed through the body and positioned adjacent the adjustment member to receive a section of the actuator rod therein to facilitate contacting the actuator rod from a position outside of the body; and an attachment opening disposed through the body for attachment with a linkage member;

wherein the linkage member is connected with a movable member of the turbocharger assembly.

12. The actuator mechanism as recited in claim 11 wherein the rod end connector body members each include registration surface features that are positioned at identical locations to confirm alignment of the body members.

13. The actuator mechanism as recited in claim 11 wherein the rod end connector includes a flange that extends radially outwardly from the body adjacent the longitudinal end of the body having the opening, the actuator rod being disposed through a central opening through the flange.

14. The actuator mechanism as recited in claim 11 wherein the rod end connector comprises a lock nut threadably engaged with the actuator rod, and wherein the lock nut is positioned against the flange.

15. The actuator mechanism as recited in claim 11 wherein the rod end connector attachment opening further comprises a ball member movably disposed therein.

16. The actuator mechanism as recited in claim 15 wherein the rod end connector ball member is movable omnidirectionally within the opening and includes a radiused outside surface.

17. The actuator mechanism as recited in claim 16 wherein the rod end connector ball member include opposed axially facing surfaces and a centrally positioned opening extending through the axially facing surfaces.

18. The actuator mechanism as recited in claim 11 wherein the actuator is pneumatically operated and includes a diaphragm disposed therein, and wherein the actuator rod is connected with the diaphragm.

19. A method for attaching an actuator rod extending from an actuator to a rod end connector, the actuator being used to control a movable member of a turbocharger assembly, the method comprising the steps of:

inserting an end of the actuator rod into a body of a rod end connector and rotating a threadable member disposed within the body to threadably engage the actuator rod to achieve a connection between an attachment member of the rod end connector and a desired linkage, wherein the body includes an opening therethrough that accommodates a section of the actuator rod disposed within the body and that enables contact of the actuator rod from a position outside of the body;

placing the rod end connector within a fixture comprising at least one member that holds the rod end body in place, and a member that contacts and holds the actuator rod section extending through the opening in a fixed position relative to the body; and tightening a lock nut against a surface of the body, the lock nut being threadably engaged with a portion of the actuator rod extending outside of the body;

wherein during the step of tightening, the actuator rod remains fixed relative to the body.

20. The method as recited in claim 19 wherein the actuator is pneumatically operated and includes a diaphragm disposed therein, and wherein the actuator rod is connected with the diaphragm.

* * * * *